US007438322B2

(12) United States Patent
Miller

(10) Patent No.: US 7,438,322 B2
(45) **Date of Patent: *Oct. 21, 2008**

(54) LABEL

(75) Inventor: Paul Anthony Miller, Kambah (AU)

(73) Assignee: Global Apeel Limited (GB)

( * ) Notice: Subject to any disclaimer, the term of this patent is extended or adjusted under 35 U.S.C. 154(b) by 584 days.

This patent is subject to a terminal disclaimer.

(21) Appl. No.: 10/794,963

(22) Filed: Mar. 5, 2004

(65) Prior Publication Data

US 2004/0212190 A1 Oct. 28, 2004

Related U.S. Application Data

(63) Continuation-in-part of application No. PCT/AU02/01224, filed on Sep. 5, 2002.

(30) Foreign Application Priority Data

Sep. 5, 2001 (AU) ..... PR7493
Jan. 25, 2002 (AU) ..... PS0122

(51) Int. Cl.
*B42D 15/00* (2006.01)

(52) U.S. Cl. ..... 283/81; 283/101; 283/105; 428/41.9

(58) Field of Classification Search ..... 283/81, 283/101, 51, 71, 105; 40/299; 428/41.9, 428/42.2, 42.3, 45
See application file for complete search history.

(56) References Cited

U.S. PATENT DOCUMENTS 2,091,346 A * 8/1937 Wright ..... 40/310
3,315,386 A 4/1967 Kest
3,484,976 A * 12/1969 Shea ..... 40/310
3,706,626 A * 12/1972 Smith et al. ..... 428/42.3
3,799,829 A * 3/1974 Heatwole ..... 156/235
3,822,492 A * 7/1974 Crawley ..... 40/638
3,889,407 A * 6/1975 Elzer ..... 40/638
3,914,483 A * 10/1975 Stipek, Jr. ..... 428/42.3
4,032,679 A * 6/1977 Aoyagi ..... 428/42.3
4,397,261 A * 8/1983 Jones ..... 118/505
4,549,750 A * 10/1985 Stone et al. ..... 283/79
4,671,003 A * 6/1987 Vitol ..... 40/638
4,983,438 A * 1/1991 Jameson ..... 428/42.3
4,995,642 A * 2/1991 Juszak et al. ..... 283/105
5,172,936 A * 12/1992 Sullivan et al. ..... 283/81
5,284,363 A 2/1994 Gartner et al.
5,320,387 A * 6/1994 Carlson ..... 283/75
5,329,713 A 7/1994 Lundell
5,376,418 A 12/1994 Rogers et al.
5,409,754 A * 4/1995 Yasuda et al. ..... 428/43
5,484,168 A * 1/1996 Chigot ..... 283/67

(Continued)

FOREIGN PATENT DOCUMENTS

AU B-36223/89 1/1990

(Continued)

*Primary Examiner*—David P. Bryant
*Assistant Examiner*—Eric A Gates
(74) *Attorney, Agent, or Firm*—Alston & Bird LLP

(57) ABSTRACT

A label for affixing to a container of produce is disclosed, the label including a front portion for carrying labelling indicia, and an adhesive backing; the front portion including a token for identifying the produce, the token being readily severable from the front portion when the label is affixed to the container.

9 Claims, 5 Drawing Sheets

U.S. PATENT DOCUMENTS

| | | | | | |
|---|---|---|---|---|---|
| 5,535,536 | A | | 7/1996 | Comann | |
| 5,547,227 | A | * | 8/1996 | Laurash et al. | 283/81 |
| 5,654,056 | A | * | 8/1997 | Combe | 428/41.7 |
| 5,658,631 | A | | 8/1997 | Bernstein et al. | |
| 5,662,976 | A | | 9/1997 | Popat et al. | |
| 5,700,535 | A | * | 12/1997 | Galsterer et al. | 428/40.1 |
| 5,837,337 | A | * | 11/1998 | Schnitzer | 428/40.1 |
| 5,853,836 | A | * | 12/1998 | Zoss | 428/40.1 |
| 5,958,536 | A | * | 9/1999 | Gelsinger et al. | 428/40.1 |
| 6,016,618 | A | * | 1/2000 | Attia et al. | 40/633 |
| 6,017,408 | A | * | 1/2000 | Rogers et al. | 156/249 |
| 6,186,554 | B1 | * | 2/2001 | Raming | 283/81 |
| 6,217,966 | B1 | | 4/2001 | Finster et al. | |
| 6,331,018 | B1 | * | 12/2001 | Roth et al. | 283/81 |
| 6,378,906 | B1 | * | 12/2001 | Pennaz | 283/81 |
| 6,491,995 | B1 | * | 12/2002 | Schreiner | 428/40.1 |
| 6,511,725 | B1 | * | 1/2003 | Rawlings | 428/40.1 |
| 6,533,325 | B1 | * | 3/2003 | Steidinger | 283/105 |
| 6,656,555 | B1 | | 12/2003 | McKillip | |
| 6,688,649 | B2 | * | 2/2004 | Casagrande | 283/61 |
| 6,749,230 | B1 | * | 6/2004 | Casagrande | 283/61 |
| 6,896,295 | B1 | * | 5/2005 | Casagrande | 283/61 |
| 6,991,259 | B2 | * | 1/2006 | Schwarzbauer et al. | 283/62 |
| 7,306,690 | B2 | * | 12/2007 | Hodsdon et al. | 156/247 |
| 2008/0100057 | A1 | * | 5/2008 | MacPhee | 283/101 |

FOREIGN PATENT DOCUMENTS

| | | | |
|---|---|---|---|
| AU | A-24821/95 | | 1/1996 |
| AU | 756208 | | 6/2000 |
| FR | 2 634 931 | A1 | 2/1990 |
| FR | 2 706 214 | A1 | 12/1994 |
| FR | 2 724 479 | A1 | 3/1996 |
| GB | 2 352 707 | A | 2/2001 |

* cited by examiner

LABEL

CROSS-REFERENCE TO RELATED APPLICATIONS

This application is a continuation-in-part of PCT Application No. PCT/AU02/01224, filed Sep. 5, 2002, which claims priority from Australian Patent Application Nos. PR 7493 filed Sep. 5, 2001 and PS 0122 filed Jan. 25, 2002, which are hereby incorporated herein by reference.

TECHNICAL FIELD

This invention relates to a label.

The invention has particular application to labels and labeling methods which include a frangible or severable portion.

The invention is particularly suited for use in the wine industry.

BACKGROUND OF INVENTION

It is known for adhesive labels to be attached to wine bottles and the like.

SUMMARY OF INVENTION

The present invention aims to provide an alternative to known labels and labeling methods.

This invention in one aspect resides broadly in a label for affixing to a container of produce, the label including:

a front portion for carrying labeling indicia;

an adhesive backing substantially covering one side of the front portion;

a non-stick backing sheet affixed to the adhesive backing, and a token for identifying the produce;

a portion of the front portion constituting the token and being readily severable from the front portion when the label is affixed to the container, a portion of the backing sheet being removable from the adhesive backing such that another portion of the backing sheet remains attached to the token.

It is also preferred that the front portion has perforations to facilitate the severing of the token therefrom.

It is also preferred that the perforations in the front portion extend into the backing sheet affixed to the adhesive backing.

It is also preferred that the backing sheet is cut through proximate the perforations such that a portion of the backing sheet remains attached to the token when the remainder of the backing sheet is removed from the adhesive backing for affixing the label to a container.

In another aspect this invention resides broadly in a method of labelling produce in a container, the method including:

providing a label for affixing to the container, the label having a front portion for carrying labeling indicia, an adhesive backing substantially covering one side of the front portion, a non-stick backing sheet affixed to the adhesive backing, and a token for identifying the produce; a portion of the front portion constituting the token;

removing a portion of the backing sheet from the adhesive backing such that another portion of the backing sheet remains attached to the token, and affixing the label to the container by the adhesive exposed when the portion of the backing sheet is removed therefrom;

the token being readily severable from the front portion when the label is affixed to the container.

In another aspect this invention resides broadly in a roll of labels for affixing to a container of produce, each label including:

a front portion for carrying labeling indicia;

an adhesive backing substantially covering one side of the front portion;

a non-stick backing sheet affixed to the adhesive backing, and a token for identifying the produce;

a portion of the front portion constituting the token and being readily severable from the front portion when the label is affixed to the container, a portion of the backing sheet being removable from the adhesive backing such that another portion of the backing sheet remains attached to the token;

wherein the non stick backing sheet constitutes continuous material forming the roll.

In another aspect this invention resides broadly in a label for affixing to a container of produce, the label including:

a front portion for carrying labeling indicia;

an adhesive backing substantially covering one side of the front portion;

a non-stick backing sheet affixed to the adhesive backing, and a token for identifying the produce;

a portion of the front portion constituting the token and being readily severable from the front portion when the label is affixed to the container, a portion of the backing sheet being removable from the adhesive backing such that another portion of the backing sheet remains attached to the token;

wherein the backing sheet is cut through such that the other portion of the backing sheet which remains attached to the token is smaller than the token, the adhesive where the larger token extends beyond the smaller other portion of the backing sheet being less adhesive than the adhesive backing.

It is preferred that the token forms an edge portion extending around the other portion of the backing sheet remaining attached to the token.

It is also preferred that the adhesive on the edge portion is stamped to render it less adhesive.

In another aspect this invention resides broadly in a method of labeling produce in a container with a label as defined above.

In another aspect this invention resides broadly in a roll of labels as defined above for affixing to a container of produce.

DESCRIPTION OF DRAWINGS

In order that this invention may be more easily understood and put into practical effect, reference will now be made to the accompanying drawings which illustrate a preferred embodiment of the invention, wherein:

FIGS. 3-7 illustrate a first embodiment of the invention, wherein:

FIG. 3 is a cross-sectional elevation through the label of FIG. 1 as seen along M;

FIG. 4 is a perspective view of the rear of the label with the non-stick backing affixed:

FIG. 5 is a perspective view of the rear of the label with the non-stick backing removed;

FIG. 6 is a perspective view of the front of the label with the token intact, and FIG. 7 is a perspective view of the front of the label with the token removed;

DESCRIPTION OF PREFERRED EMBODIMENTS OF INVENTION

Figure 1:
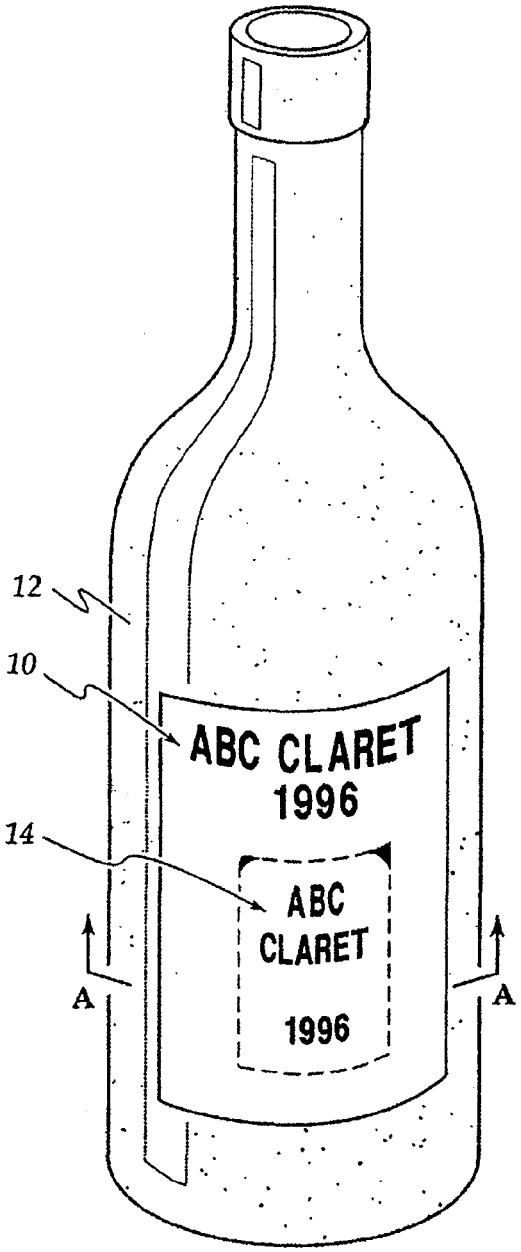
FIG. 1 is a perspective view of a label in accordance with the invention on a wine bottle.
Figure 2:
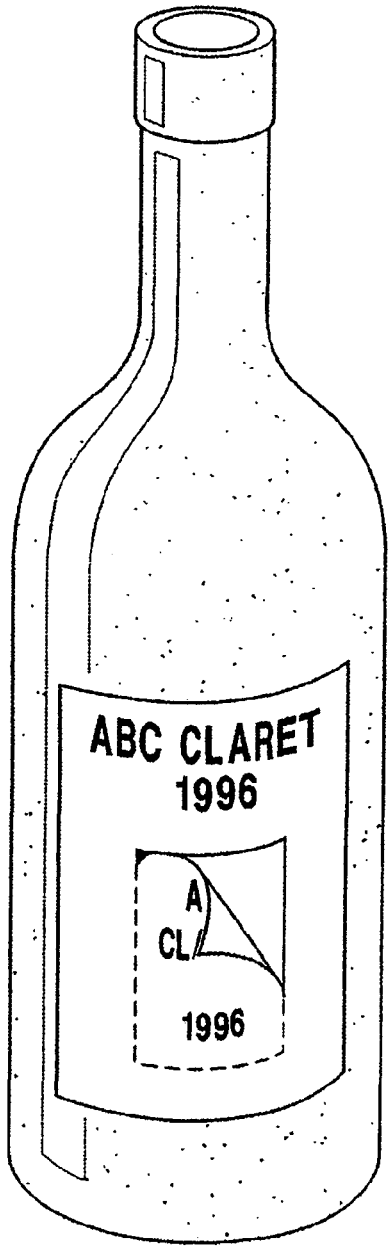
FIG. 2 is a perspective view of the label of FIG. 1 showing the token partially removed.

As can be seen in FIG. 1, a wine label 10 is affixed to a bottle 12 and has a tear-out token which can be readily removed for collection or future reference, as best seen in FIG. 2.

Figure 3:
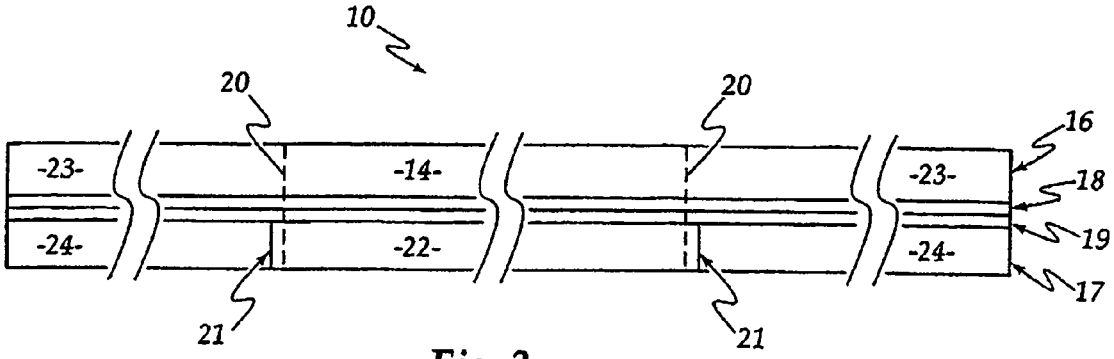

FIG. 3 is a cross-sectional elevation through the label along line AA seen in FIG. 1. Illustrating a first embodiment of the invention, it shows the composition of label 10 as including a front portion 16 for carrying labeling indicia and an adhesive backing 18. Front portion 16 has a token 14 for identifying the wine and as seen in FIG. 2, is readily severable from the front portion 16 when the label 10 is affixed to the bottle.

Label 10 also includes a non-stick backing sheet 17,19 affixed to adhesive backing 18. The backing sheet has a paper or paper-like substrate 17 and a non-stick layer 19 in known manner. Perforations 20 in front portion 16 facilitate the severing of token 14 from the front portion, and extend into the backing sheet 17 affixed to adhesive backing 18 by non-stick layer 19.

Figure 4:
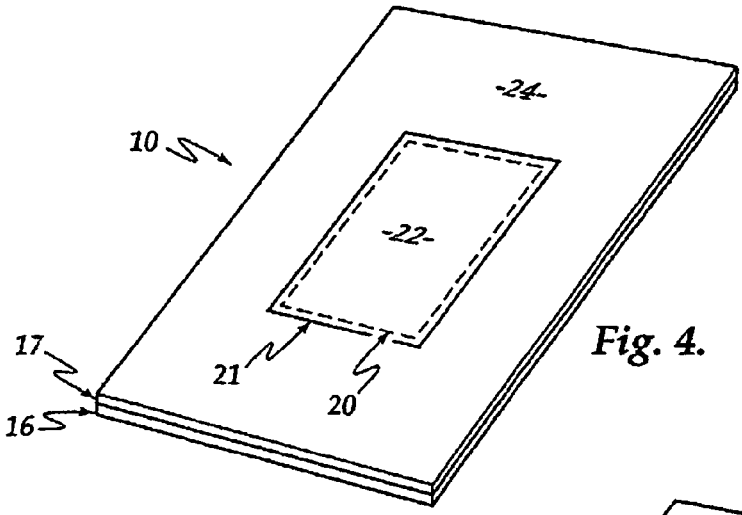
Figure 5:
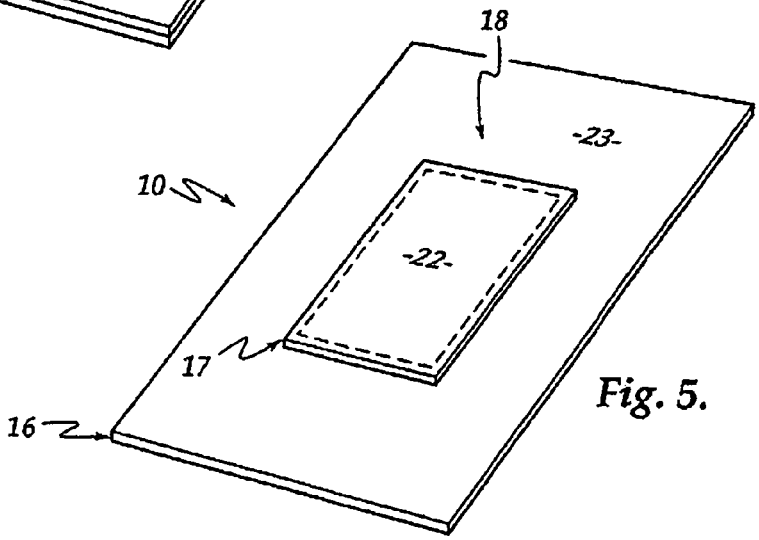
Figure 6:
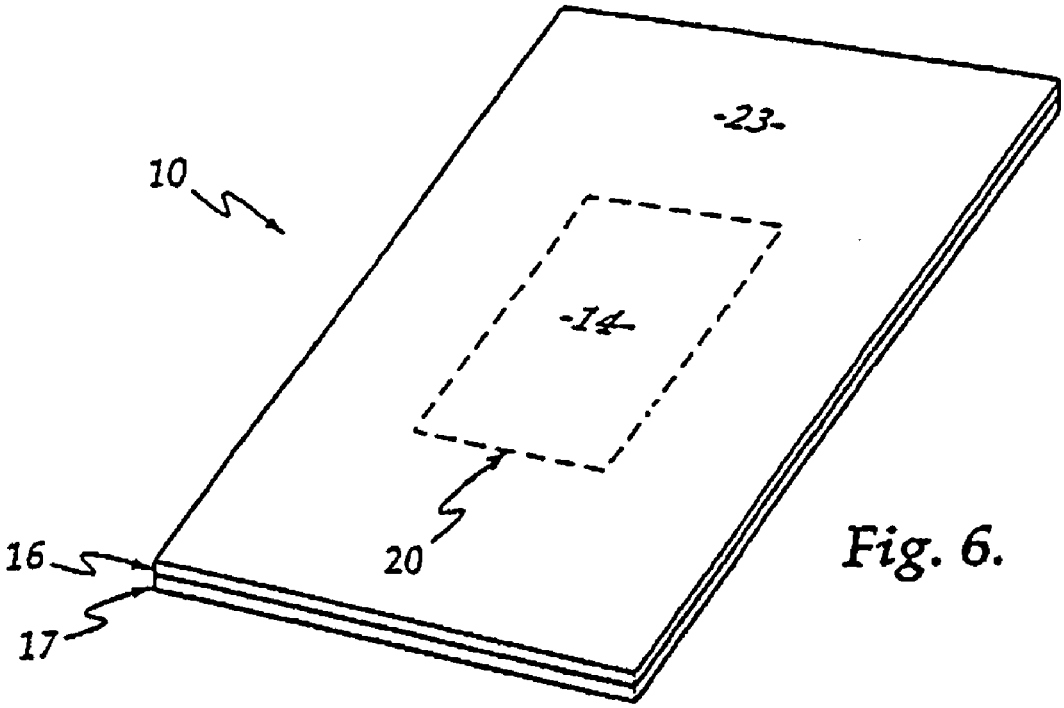
Figure 7:
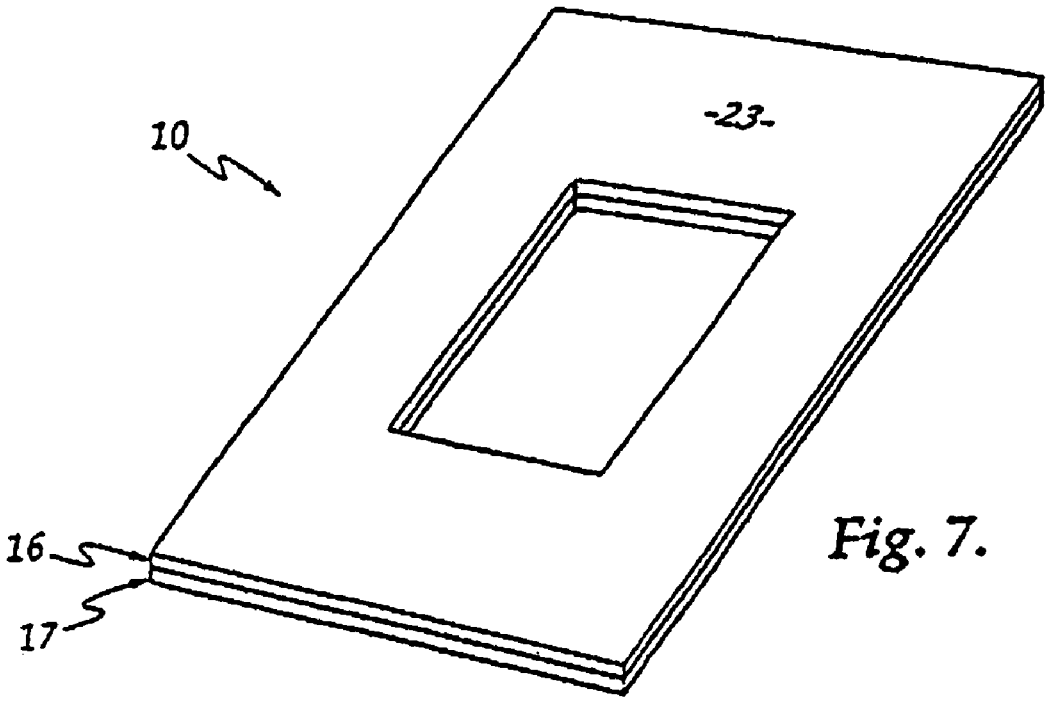

Backing sheet 17 is also is cut through at 21 proximate perforations 20, shown in FIGS. 4 and 5 externally of the perforations, such that a portion 22 of backing sheet 17 remains attached to token 14 when the remainder 24 of backing sheet 17 is removed from adhesive backing 18 for affixing label 10 to bottle 12. Cut 21 can also be made within the perforation 20, and in this preferred embodiment a thin strip of adhesive remains affixed to the underside of the edge of token 14.

FIGS. 8-12 illustrate a second embodiment of the invention in views which correspond with those of FIGS. 3-7 as described above with respect to the first embodiment of the invention. For convenience of reference and description, where the features correspond, the reference numerals used in the embodiment illustrated in FIGS. 8-12 are the same as those used in the above description of the first embodiment.

Figure 8:
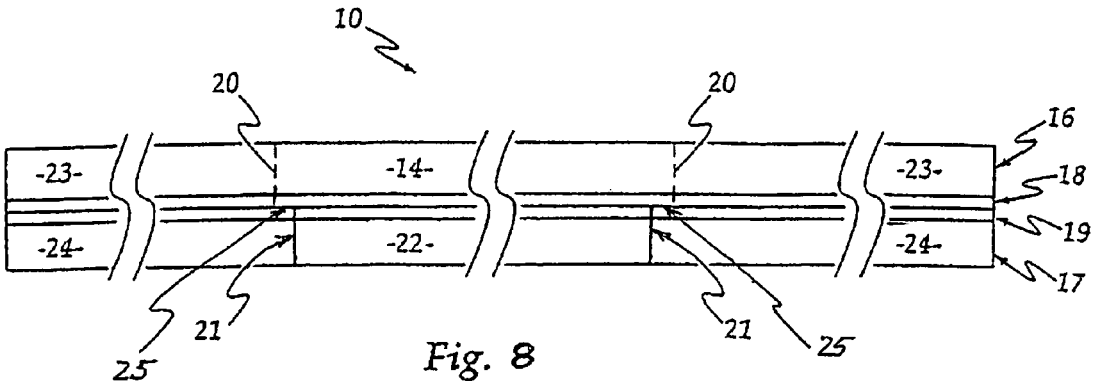
FIGS. 8-12 illustrate a second embodiment of the invention in views which correspond with those of FIGS. 3-7 as described above with respect to the first embodiment of the invention.
Figure 9:
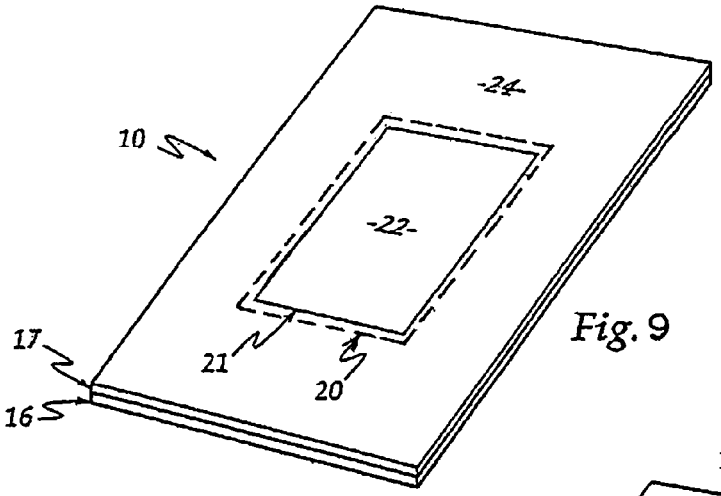

FIG. 8 is a cross-sectional elevation of the second embodiment of the invention through the label along line AA seen in FIG. 1 and illustrates the composition of label 10 as including a front portion 16 for carrying labeling indicia and an adhesive backing 18. Front portion 16 has a token 14 for identifying the wine and as seen in FIG. 2, is readily severable from the front portion 16 when the label 10 is affixed to the bottle.

Label 10 also includes a non-stick backing sheet 17,19 affixed to adhesive backing 18. The backing sheet has a paper or paper-like substrate 17 and a non-stick layer 19 in known manner. Perforations 20 in front portion 16 facilitate the severing of token 14 from the front portion. Perforations 20 do not extend into the backing sheet 17 affixed to adhesive backing 18 by non-stick layer 19.

Backing sheet 17 is cut through at 21 internally of perforations 20, such that a portion 22 of backing sheet 17 remains attached to token 14 when the remainder 24 of backing sheet 17 is removed from adhesive backing 18 for affixing label 10 to bottle 12. Cut 21 is within the perforation 20 so that a thin strip 25 of adhesive remains affixed to the underside of the edge of token 14.

The adhesive on strip 25 is of lesser adhesiveness than the remainder of adhesive backing 18. In practice the adhesive on strip 25 is deadened by stamping this strip with a suitably shaped stamp or die, whereby the adhesiveness of this portion 25 of adhesive backing 18 is reduced.

It will be appreciated that the edge portion 25 of reduced adhesiveness is attached to the container less aggressively than the remainder of label 10, thereby facilitating the removal of token 14 together with the backing sheet portion 22.

Figure 10:
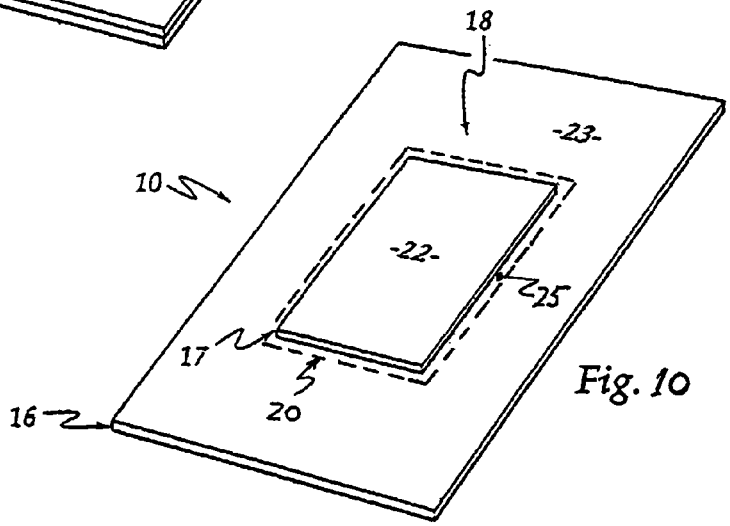
Figure 11:
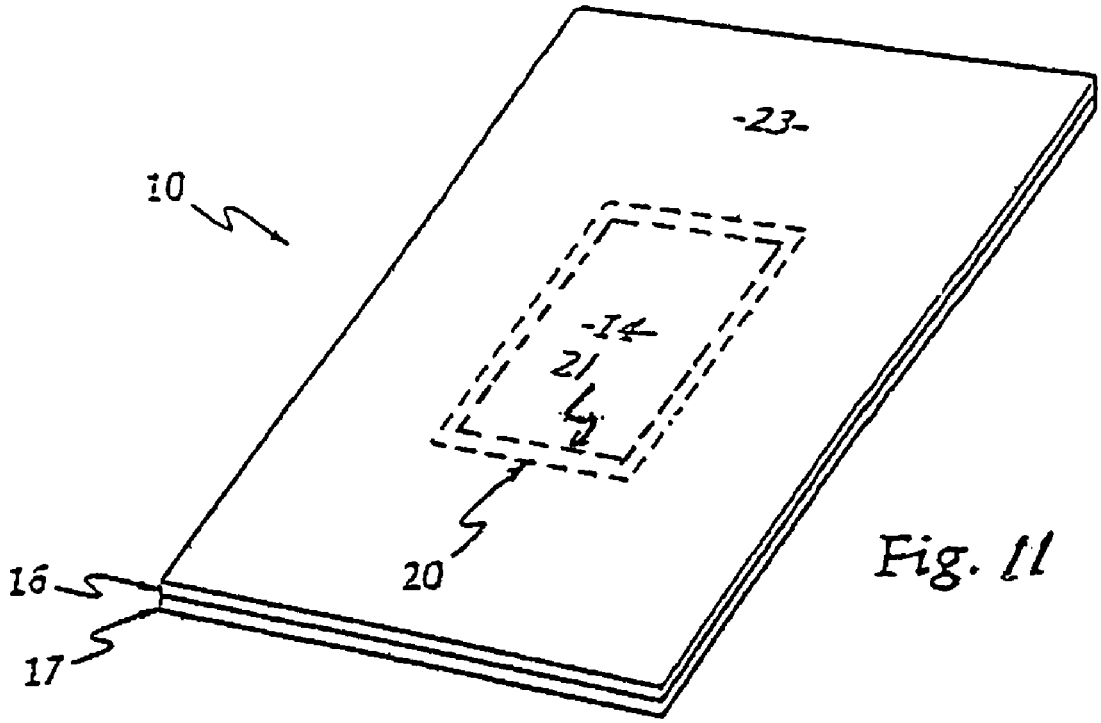
Figure 12:
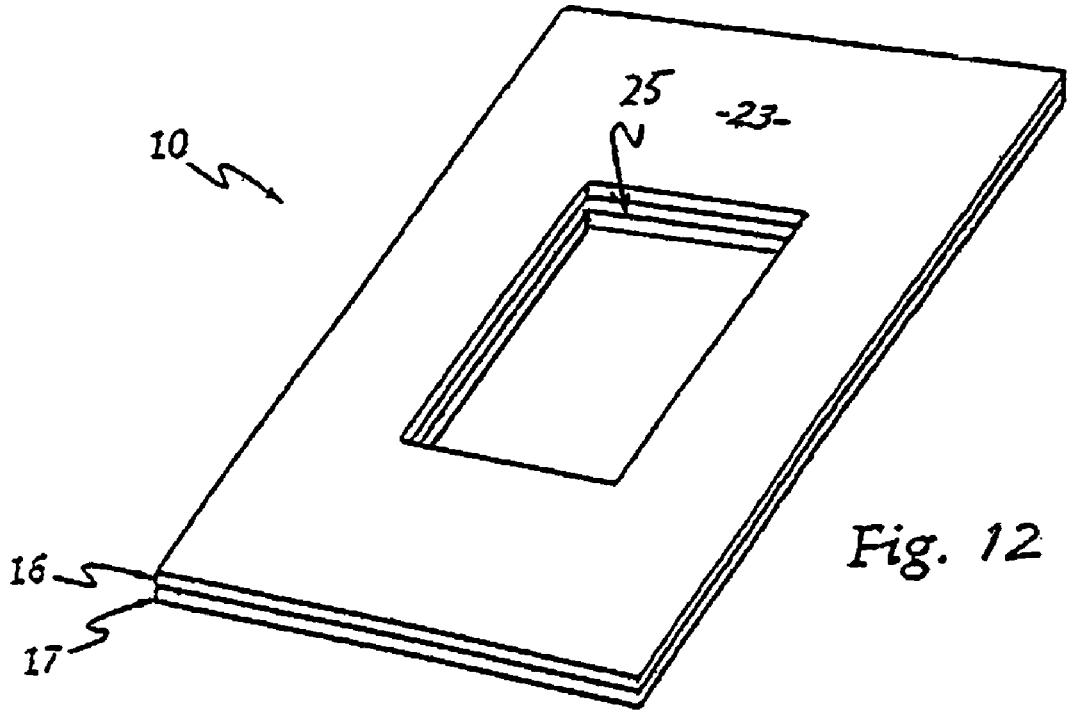

In use, as best seen in FIGS. 4-7 and 9-12, a wine or other produce in a container is labeled in according with the present invention with a label 10 having a front portion 16 for carrying labeling indicia and having a token 14 for identifying the wine, an adhesive backing 18, and a non-stick backing sheet 17 affixed to adhesive backing 18. As seen in FIGS. 5 and 10, portion 24 of backing sheet 17 is removed from adhesive backing 18 such that another portion 22 of backing sheet 17 remains attached to token 14. Label 10 is affixed to the bottle by the adhesive backing 18 exposed when portion 24 of backing sheet 17 is removed. As seen in FIGS. 6, 7, 11 and 12, token 14 is readily severable from front portion 16 when label 10 is affixed to the bottle, leaving portion 23 of label 10 remaining affixed to the bottle.

It will be readily appreciated that non-stick backing sheet 17,19 affixed to adhesive backing 18 can be a portion of a continuous length of non-stick backing sheet material and which in known manner can be wound into a roll.

It will be appreciated that the present invention has many uses and advantages over known labels. For example with wine labeled in accordance with the invention, at restaurants or the like when the wine has been enjoyed the token can be removed and retained as an aide-memoir, souvenir, collectible etc, thereby removing the necessity to write the name or details of the wine on a piece of paper. Token 14 can be readily fixed in a scrap-book or the like by peeling back non-stick portion 22 to expose the adhesive layer 18 on the token.

It also avoids the practice of soaking off wine labels, which is difficult with more modern labels which use contact adhesives often sufficiently aggressive to result in the label being destroyed in attempts to remove it.

The invention is also useful in conducting promotions of goods bearing the label. For example prizes can be offered for the return of a given number of tokens which have been removed from the labels.

It will of course be realized that whilst the above has been given by way of an illustrative example of this invention, all such and other modifications and variations hereto, as would be apparent to persons skilled in the art, are deemed to fall within the broad scope and ambit of this invention as is herein set forth.

The invention claimed is:

1. A label for affixing to a container, the label including:

a front portion;

an adhesive backing covering one side of the front portion;

a backing sheet with a non-stick surface removably affixed to the adhesive backing, and an integral token;

an internal portion of the front portion constituting the integral token and being readily severable from the front portion via the rupturing of a closed line of perforations which define the perimeter of the integral token within the label, a portion of the backing sheet being removable from the adhesive backing such that another portion of the backing sheet remains attached to the integral token and said another portion having a non-stick surface such that said another portion can be separated from the token;

wherein the backing sheet is cut through such that the another portion of the backing sheet which remains attached to the integral token is smaller than the token, the adhesive where the integral token extends beyond the another portion of the backing sheet being less adhesive than the adhesive backing.

2. A label as claimed in claim 1, wherein the integral token forms an edge portion extending around the another portion of the backing sheet remaining attached to the token.

3. A label as claimed in claim 1, wherein the adhesive on the edge portion is stamped to render it less adhesive.

4. A plurality of adhesive labels disposed on a roll of backing sheet with a non-stick surface, each adhesive label including a closed line of perforations within the label to define an internal integral token which is separable from the remainder of the adhesive label, a closed cut being provided in the backing sheet underneath the internal token to define a portion of the backing sheet which can be removed from the remainder of the backing sheet along with the label, said closed cut not extending outside said closed line of perforations, and said portion of the backing sheet which can be removed having a non-stick surface such that said portion of the backing sheet can be separated from the token, wherein said closed cut is inside said closed line of perforations, and the integral token includes an edge portion which is defined between the closed cut and the closed line of perforations, said edge portion having reduced adhesiveness.

5. A plurality of adhesive labels as claimed in claim 4, wherein when the adhesive label is removed from the roll of backing sheet it carries with it the portion of backing sheet, and wherein said removed label can then be applied to a container with the portion of the backing sheet interposed between the integral token and the container.

6. An adhesive label ready for application to a container and including an integral token, the adhesive label including a closed line of perforations within the label to define said integral token which is separable from the remainder of the adhesive label, an adhesive backing covering one side of the adhesive label including said integral token, a portion of a backing sheet being provided under said integral token, said portion of backing sheet not extending beyond the closed line of perforations, and said portion of backing sheet having a non-stick surface such that it can be separated from the token to expose the adhesive coating after the token has been separated from the remainder of the adhesive label, wherein said portion of the backing sheet is smaller that the integral token such that an edge portion of the integral token is defined between the perimeter of the portion of the backing sheet and the perimeter of the integral token, said edge portion having reduced adhesiveness.

7. An adhesive label ready for application to a container as claimed in claim 6, wherein the integral token and the remainder of the label are held together by label-material in the form of tags which extend between adjacent perforations.

8. A container having an adhesive label applied thereto, the label including a closed line of perforations within the label to define an internal integral token which is separable from the remainder of the adhesive label, an adhesive backing covering one side of the adhesive label, including said integral token, a portion of a backing sheet being provided under said integral token, said portion of backing sheet not extending beyond the closed line of perforations, and said portion of backing sheet having a non-stick surface such that it can be separated from the token to expose the adhesive coating after the token has been separated from the remainder of the adhesive label, wherein said portion of the backing sheet is smaller that the integral token such that an edge portion of the integral token is defined between the perimeter of the portion of the backing sheet and the perimeter of the integral token, said edge portion having reduced adhesiveness.

9. A container as claimed in claim 8, wherein the integral token and the remainder of the label are held together by label material in the form of tags which extend between adjacent perforations.

* * * * *